US005782345A

United States Patent [19]

Guasch et al.

[11] Patent Number: 5,782,345

[45] Date of Patent: Jul. 21, 1998

[54] PHARMACEUTICAL BOTTLE OF TWO SEPARATE SUBSTANCES WITH MIXING DEVICE, DOSED APPLICATION AND ASSEMBLY PROCESS THEREOF

[75] Inventors: Francesc Xavier Gimenez Guasch; Michael Van Wie Bergamini, both of Barcelona, Spain

[73] Assignee: Laboratorios Cusi, S.A., Spain

[21] Appl. No.: 579,138

[22] Filed: Dec. 27, 1995

[30] Foreign Application Priority Data

Dec. 4, 1995 [ES] Spain ..... 9502392

[51] Int. Cl.[6] ..... B65D 25/08

[52] U.S. Cl. ..... 206/222; 206/219

[58] Field of Search ..... 206/219, 222; 215/320, 321; 222/83; 220/780

[56] References Cited

U.S. PATENT DOCUMENTS

| | | | |
|---|---|---|---|
| 2,718,980 | 9/1955 | Strom | 220/780 |
| 4,465,183 | 8/1984 | Saito et al. . | |
| 4,682,689 | 7/1987 | Pereira et al. | 206/222 |
| 4,982,875 | 1/1991 | Pozzi et al. | 222/83 |
| 5,170,888 | 12/1992 | Goncalves | 206/222 |
| 5,353,928 | 10/1994 | Schumacher | 206/222 |
| 5,388,690 | 2/1995 | Mutterle et al. | 206/222 |

FOREIGN PATENT DOCUMENTS

| | | |
|---|---|---|
| 251193 | 1/1988 | European Pat. Off. . |
| 577200 | 1/1994 | European Pat. Off. . |

*Primary Examiner*—David T. Fidei
*Attorney, Agent, or Firm*—Klauber & Jackson

[57] ABSTRACT

In one embodiment, a container including a bottom container closed at a bottom end and open at a top end and having a tubular neck, a top container open at a top end and closed at a bottom by a tearable seal, a flap extending radially out from an exterior of the top container so that the flap surrounds the neck of the bottom container, and a tubular sleeve having a bottom end and a top end, the bottom end defined by a beveled edge and the top end closed by a truncated cone, the bottom end of the tubular sleeve being sized and shaped to be received within the open end of the top container. The tubular neck has a peripheral edge containing a first set of stria, and an interior of the tubular neck has a plurality of sealing rings. The top container engages the sealing rings of the bottom container, and the flap surrounds the neck of the bottom container, when the top container is inserted into the interior of the tubular neck. The bottom end of the tubular sleeve has a beveled edge and the top end is closed by a truncated cone. The tubular sleeve may be moved axially within the top container so that the beveled edge tears the tearable seal in the top container.

14 Claims, 6 Drawing Sheets

PHARMACEUTICAL BOTTLE OF TWO SEPARATE SUBSTANCES WITH MIXING DEVICE, DOSED APPLICATION AND ASSEMBLY PROCESS THEREOF

OBJECT OF THE INVENTION

The invention that we are now dealing with refers to a pharmaceutical container with two separate substances, and a mixing device and dosed application of the type that permit the mixing of two different substances, for which purpose it has a bottom container to house one of the products or substances, and a top container to contain the second product, the top container being retained over the bottom one, for which purpose the latter is provided in its mouth with an edge that is retained by means of a ring-shaped rib placed on the inside surface of the flap provided in the top container, which houses inside it, with the possibility of movement, a tubular sleeve whose top edge is finished with a wing after which there is a truncated-cone-shaped portion that is a medicine dropper, that is sealed by a safety seal cap that screws on the top container until the seal stops against the flap, in such a way that when the safety seal is broken, the cap continues to screw on in whose downward movement the tubular sleeve is pushed, this partially breaking the bottom of the top container, for which purpose said bottom is provided with a perforated line upon which the bottom edge of the tubular sleeve presses; the object of the invention being to achieve coupling between the bottom and top container by means of perfectly airtight sealing and without the possibility of one of the containers being able to turn over the other, obtaining greater damage-proofness of the container.

Another object of the invention consists of providing to the tubular sleeve some means that provide for gentler cutting, facilitating the handling by the user at the same time that it prevents the effect of compacting of the powder when the product is of a powder type and the effect of the ejecting piston of the product contained in the top container is a liquid.

Another object of the invention is to provide the coupling of this type of container in medicine droppers or correctors used in medicine to apply a product directly in the patient's vein, or in any other medical tool that has this type of connection, such as for example in eye surgery that requires the use of intra-ocular irrigations, application in sterile solutions, etc. In other words, the application permits coupling and application of the container in different medical tools.

Besides, the invention has the object of facilitating automatic assembly of the different elements that comprise the container.

On the other hand, the invention improves the unit defined by the cap and the safety seal, obtaining a more effective and ergnomic coupling with the top container.

It should be indicated that the described container, allows during the assembly process that two weighings can be done, which since the weight of each one of the two elements that comprise the container is known, it is possible to determine if the filling of the bottom and top containers has been done correctly.

BACKGROUND OF THE INVENTION

The prior art closest to the invention is Spanish patent of invention no. P-9300651 of the same owner, which consists of a container of the type described above, which has the inconvenience that the bottom container can turn with regard to the top one and vice-versa, which determines an airtightness and damage-proofness that can be improved.

Another problem that the cited patent of invention has consists of that inside the bottom container there is a connection area of the neck with the container that includes a projection that upon dosing can prevent the entire content of the bottom container from coming out.

Besides, the tubular sleeve of said patent of invention is characterized in that the cutting area is defined by a longitudinal appendix, the remaining perimeter being flat, which can cause fastening and the cutting is not done suitably.

Another feature of the patent of invention consists of the outlet hole of the medine dropper provided in the tubular sleeve, having a diameter, that though it is not described, is sealed by a needle that is included in the cap. This needle has to be thin, and has to be able to move rotating at the same time that pressure is exerted on the walls of the hole, which can cause it to break and to remain trapped in the hole sealing it and preventing it from operating correctly.

Another characteristic of the indicated invention, consists of the top container having some sawteeth that are complemented with some solid sawteeth of the cap, with the same structure and in the same number as the previous ones, which represents the inconvenience that upon placing the cap on the top container, there may be deformations in the sealing ring, it being necessary to have a significant sealing stress which in some cases could cause the locking of the teeth of the cap in those of the seal, or the breaking of the seal when screwing on or screwing off takes place, thus resulting in inadequate sealing or screwing or or screwing off.

Another feature of the cited invention, consists of that in the movement of the tubular shirt,in order to effect the cutting of the bottom of the top container, it is done by the pushing of the cap on the top part of the eye dropper that can cause the locking between both pieces, and breaking by twisting the above cited needle, which prevents the correct use thereof.

Besides, the container of the cited patent, has the inconvenience that it cannot be coupled directly to any medical tool of those that are provided with a "LUER LOK" type connection, which consists of a cylindrical projection that has an outside thread from which the cited coupling is made possible.

DESCRIPTION OF THE INVENTION

In order to solve the above cited inconveniences, the invention is characterized in that the inside surface of the flap of the top container has at least two ring-shaped ribs and a radial stria that is complemened with both ring-shaped edges located in the bottom container, that are likewise provided with a stria. This structure determines that upon coupling both containers, an airtight coupling is achieved at the same time that the possibility of one of the containers being able to rotate with regard to the other being prevented, which establishes obtainment of greater damage-proofness in view of possible mishandling.

The ring-shaped edges of the bottom container are slightly conical to facilitate the entry of the top container and impeding removal thereof in the event of mishandling.

Besides, said ring-shaped edges carry out the self-centering and guiding in the assembly process of the top container on the bottom container.

The stria has a triangular section and the number striae of the top container does not have to coincide with that of the bottom container.

The bottom container is provided with a perimetric shoulder placed in the top part thereof that can act as the stop of the top container and define a self-centering means of the latter in the assembly process.

The base of the bottom container has a flat perimetric area that makes the container more stable.

The inside surface of the neck of the bottom container includes a plurality of sealing rings that achieve greater airtightness in the coupling of the bottom container on the top one.

The inside surface of the bottom container, in the connection area with the neck, is curved which makes it easier for all the product to come out.

The bottom edge of the tubular sleeve is helicoidal with a bevel-edge, except a small horizontal section that constitutes the non-cutting area from which the partial cutting of the bottom of the top container is provided, in such a way that a gentler cutting is achieved, preventing the forming of particles at the same times that handling by the user is easier. Besides this structure of the tubular sleeve prevents the compacting effect of the powder and the effect of the ejecting piston, if the product contained in the top container is a liquid.

The outside surface of the tubular sleeve includes a plurality of rings that ensures the sweeping of the powder that comprises the product contained in the top container and in turn they improve the airtightness and damage-proofness between both elements.

Below the last ring provided for in the tubular sleeve, this has a diameter slightly smaller than the rest of the body, in such a way that thanks to this characteristic and to that of the rings, the stress of inserting the tubular sleeve in the top container is very small and on the contrary that of the removal is very great, preventing mishandling and that the tightening of the bottom container for dosing causes the tubular sleeve to come loose.

Besides, the small reduction of the diameter facilitates unmolding of the tubular sleeve that is done in the manufacturing process.

The top container is provided in the inner contour of its mouth a curved bevel that facilitates the entry of the tubular sleeve. This characteristic together with that of the smaller diameter of the bottom part of the tubular sleeve, determine greater quality of the unit, since it is not necessary to confront in an entirely exact manner the two parts for the assembly thereof, thus preventing that an alignment that is not exact from causing deformation of one of the containers, upon the tolerance being greater to insert the end of the tubular sleeve in the top container.

The outlet hole of the truncated-cone-shaped portion that comprises the medicine dropper has a widening slightly reversed truncated-cone-shaped wherein the hollow cylindrical center pin provided for in the cap is inserted, that provides the sealing all along with widening, with the advantage that the hollow cylinder can bend in the operation of screwing on and screwing off the cap, whereby the rubbing against the inside walls of the slightly truncated-cone-shaped hole is less, achieving that the hollow cylinder neither breaks not becomes locked in said hole.

The characteristic that the hole is slightly reversed truncated-cone shaped facilitates the control of the volume of the drop.

The teeth the comprise the sealing means that are located in the top container are placed in a connection area of the flap, instead of being high up with regard to this point, in such a way that the maximum path and the appearance is improved avoiding dirty areas at the same time that it closes more easily.

Besides, the safety seal of the cap has a plurality of oblique flexible wings whose number does not have to coincide with that of the teeth in the seal of the top container in such a way that said wings can bend thus the seal is not deformed when the sealing takes place, preventing the fact that a stress must be exerted on the sealing that in some cases can cause locking between the seal and the cap, in such a way that it prevents unsuitable sealing or inadequate screwing on or off.

The connection of the cap to the safety seal is done by means of some teeth provided for in the bottom edge of the cap, that widen in the bottom part thereof and are connected to the seal by means of a side pin, in such a way that upon screwing on or off the cap together with the safety seal in order to assemble the container, the teeth stop against the projection in which there are the teeth of the top container.

The flexible wings of the safety seal extend beyond the top edge of the latter, in such a way that they rest on the edge of the cap and are preferably located after the teeth of the bottom edge of the cap, acting as nonrotating points and stopping columns, increasing the stopping stress and allowing the bending of the connecting points of the seal to ensure correct screwing on and screwing off.

The gripping means to effect the breaking of the seal is defined buy an axial wing that close to its free end has a point of connection to the seal in such a way that it determines a pre-seal that increases safety and prevents snagging of the handling machinery in the assembly process.

The gripping means to effect the breaking of the seal can be determined by a radial wing.

The cap has a ring-shaped support provided on the inside with the contact that finishes the tubular sleeve determining the pushing means of the tubular sleeve after breaking the seal and screwing on/off the cap, preventing the stop from taking place only on the tip of the medicine dropper and on the hollow cylinder, which prevents wear and malfunctioning of the unit.

The outside surface of the cap where it is gripped by the user has a slight curve and narrower stria that facilitates the ergonomy of the same.

According to a variant of the invention, the wing that finishes the tubular sleeve has a hollow cylindrical extension placed outside and coaxially to the truncated-cone shaped portion, in whose inside walls there is a helicoidal thread that determines a thread for coupling to the medicine dropper or another tool of those conventionally used in medicine.

In the event that the outlet hole of the truncated-cone-shaped portion that comprises the medicine dropper does not have a slighly truncated-cone-shaped widening, as in the patent of invention cited in the prior art, then instead of using a hollow center pin provided in the top part of the cap, there is a cylindrical extension that finishes at the bottom according to a ring-shaped edge that upon screwing the cap on the container, the mouth of the hole of the truncated-cone-shaped body is located inside the ring-shaped edge, which upon sealing the cap, remaining airtight the inside of the container with the product to be applied.

Besides, in the base of the cylindrical extension of the cap and bordering with the ring-shaped edge, a ring-shaped channel in which the edge of the truncated-cone-shaped body fits may be included, ensuring the airtight sealing.

Besides, it should be indicated that the described container, allows assembly thereof to be done by filling first of all the bottom container and closing it with the top one in order to subsequently weight the same, in such a way it can be determined if the filling has been done correctly. Afterwards the other elements in the top container is added and it tends to be a small amount of powder, and the unit is weighed again, which allows one to know whether or not the filling has been correct. Then, the tubular sleeve is assembled and the cap is screwed on with the seal. Obviously, to know if the filling of the top container has been correct, the second weighing can be done at any time during the assembly process after having deposited the element of the top container, since the different weights that each one of the parts that make up the container are known a priori, but it is not advisable as it may impede discarding thereof.

Hereinafter to provide a better understanding of this specification and forming an integral part of the same, a series of figures in which the object of the invention has been represented in an illustrative and non-restrictive manner are att hed hereto.

BRIEF DESCRIPTION OF THE FIGURES

FIG. 7 is a sectioned view of the top container that coprise one of the elements of the container of the in on.

DESCRIPTION OF A PREFERRED EMBODIMENT

Figure 1:
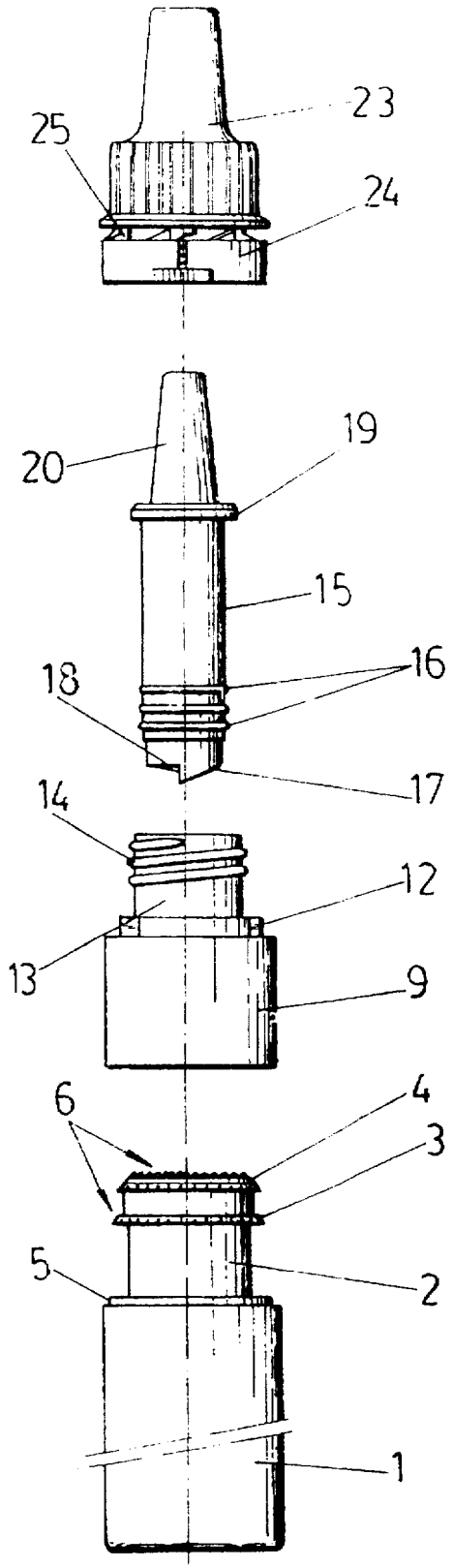
FIG. 1 is an exploded view of all of the elements that comprise the container object of the invention.
Figure 2:
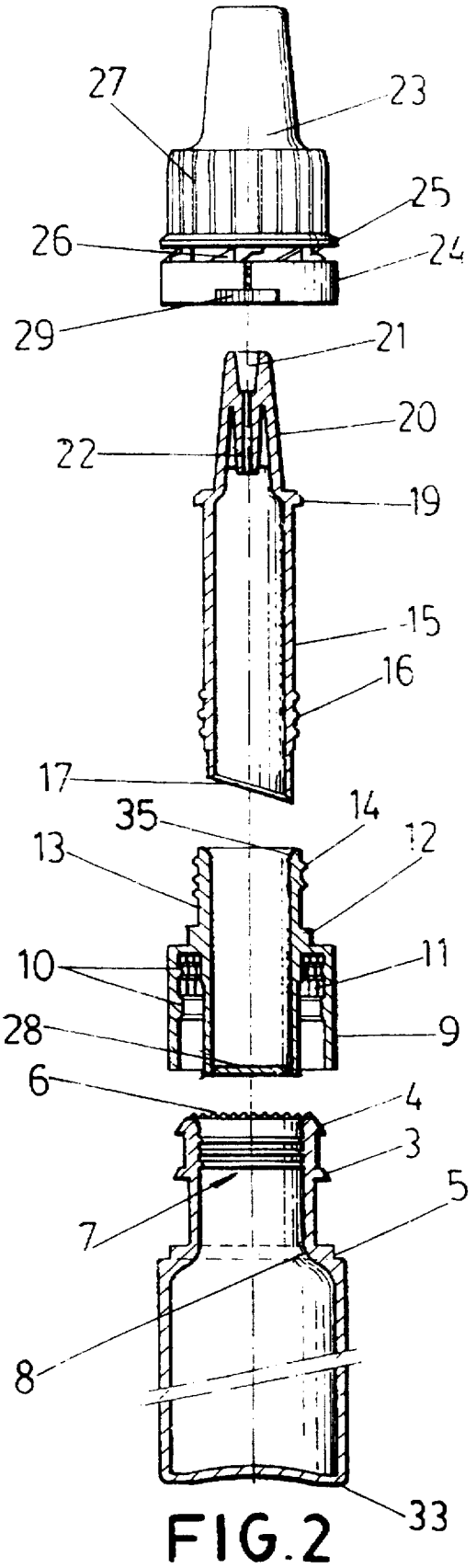
FIG. 2 is a view equivalent to the previous one in which a longitudinal section of all the elements except the cap has been made.
Figure 3:
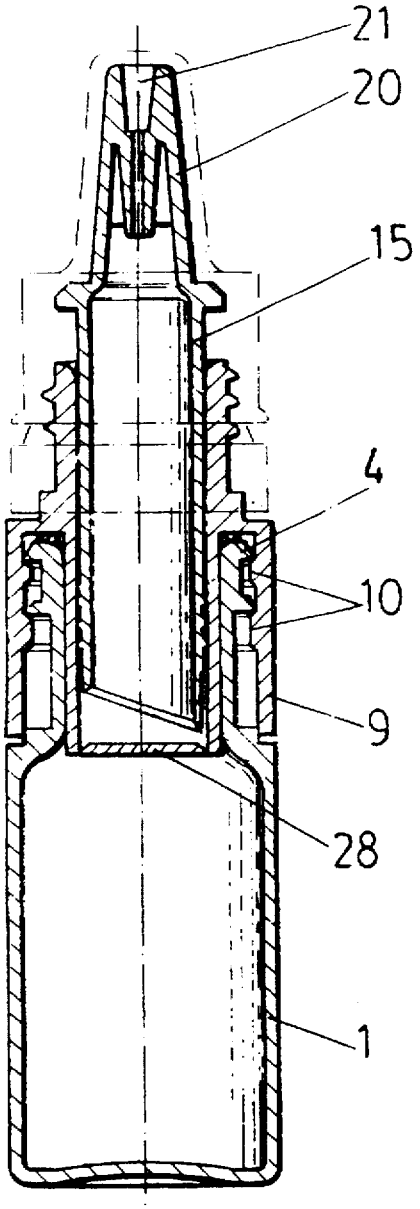
FIG. 3 is a view according to a longitudinal section of the container of the invention wherein the elements are assembled, with the exception of the cap that has been represented by a dash line for the purpose of clarifying the previous arrangement prior to use thereof.
Figure 4:
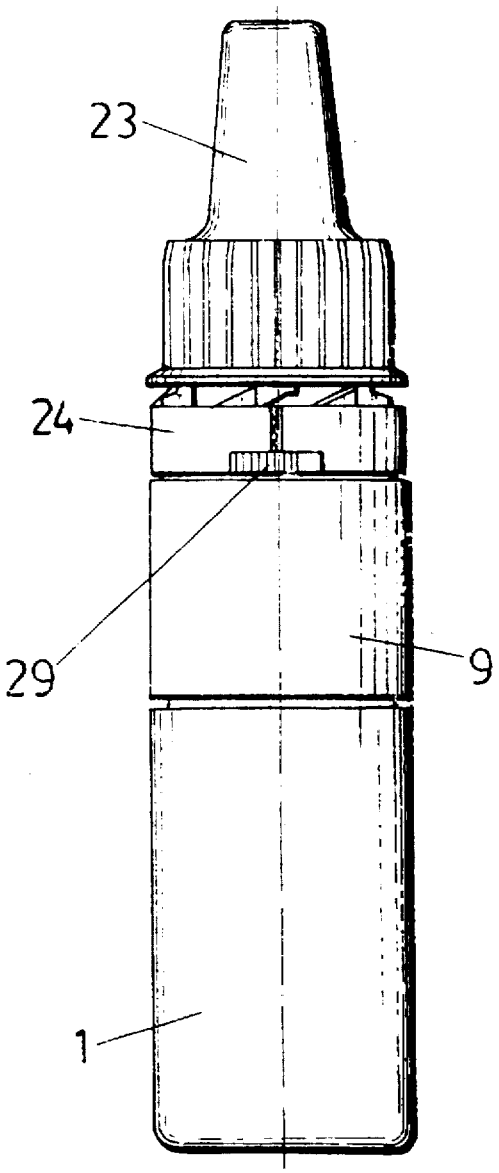
FIG. 4 is a view equivalent to the above figure without sectioning.

Hereinafter a description is made of the invention referring to the figures commented on in the previous section.

The invention is comprised from a bottom container (1) in which one of the products to be mixed is inserted and that has a neck (2) which includes both ring-shaped edges (3) and (4).

The top edge (4) is provided in the mouth of the neck (2) and just like the edge (3) it has a bevel that establishes a conicity that facilitates the automatic assembly of the top container.

This conicity facilitates the entry of the top container and on the contrary impedes its removal in the event that the user mishandles it upon trying to disassemble them.

Besides, said edges (3) and (4) carry out the self-centering and guiding of the top container in the assembly process.

Edge (3) as well as edge (4) have a stria (6).

Container (1) is provided whith a shoulder (5) whose function will be described hereinafter.

The inside surface of the container (1), in the area of connection with the neck (2), is defined by a curved surface (8) that facilitates the outflow of the entire contents of the bottom container.

Another characteristic of the bottom container is defined in that inside it and in the area of the neck there is a plurality of rings (7) that increase the airtightness with regard to the top container.

Bessides, the bottom container has in its base and on its edge a flat projection (33) that improves the stability of the base of said container, and therefore the stability of the entire container.

The top container is comprised of a flap(9) that half surrounds the neck (2) and which includes on its inside surface two ring-shaped ribs (10) that are conmplemented with the ring-shaped edges (3) and (4) of the bottom container (1).

From the bottom ring-shaped rib (10) and along the inside surface of the flap, there is a stria that runs vertically along the wall, and that extends at the top horizontal wall (this circumstance is not visible in the figures).

The stria of the flap (9) as well as that of the edges (3) and (4) have a triangular section and the number of striae in either of them does not have to coincide.

The top container has a top extension defined by a neck (13) in which there are helicoidal threads (14) that allow the cap (23) to be screwed on or screwed off, just as it will be described hereinafter.

In the connection area of the flap (9) to the neck (13) there are some teeth (12), preferably sawteeth, that comprise the fastening means of the safety seal (24) of the cap (23), just as it will be described hereinafter.

The top container has a bottom (28) that is tearable, for which purpose it has a perforated line (30).

This structure allows another second product that must be mixed with the product in the bottom container (1) to be placed in the top container.

By means of the described structures of the bottom container and of the top container, it is easily understood that the top container is placed over the bottom one, inserting in the neck (2) pressing on the sealing rings (7) to then locate the edge (4) in the top part of the flap (9), the edges (3) and (4) remaining retained by the action of the ring-shaped ribs. In this arrangement, the stria (6) of the bottom container and the stria (11) of the top container are complemented in such a way that total axial locking of the top container and the bottom container is achieved, thus preventing that one can turn with regard to the other.

Upon assembling the top container on the bottom container, the shoulder (5) of the bottom container carries out the functions of self-centering and the flap (9) can stop against it.

Through the neck (13) of the top container a tubular sleeve (15) that is provided close to its bottom edge with a plurality of sealing rings (16) that ensure the sweeping of the powder of the product contained in the top container and at the same time they improve and guarantee the airtightness between both elements, is assembled.

The bottom edge of the tubular sleeve (15) is defined by a helicoidal edge (17) with a bevel edge, with the exception of a small horizontal section (18) whose function will be explained hereinafter.

The tubular sleeve (15) is finished at the top by a wing (19) from which it continues according to a truncated-cone-shaped portion (20) that comprises the medicine dropper itself, wherein inside there is a channel (22) that opens up into a slightly reversed truncated-cone-shaped hole (21), that constitutes the outlet of the drop to be applied.

After assembling the tubular sleeve, its wing (19) remains separated a certain distance from the mouth of the top container, which facilitates that along with the truncated-cone-shaped portion (20) a self-centering means is provided upon assemblying the cap, ensuring a correct screwing on and screwing off.

The tubular sleeve (15) has a diameter slightly smaller than in the section beween the bottom edge thereof and the first sealing ring (16), which facilitates the insertion of the tubular sleeve over the top container, achieving that the insertion stress is small and on the contrary that the removal stress is very great, which is reinforced by the convex shape that said rings (16) have.

Besides, the insertion of the tubular sleeve in the top container is facilitated by the inclusion of a curved bevel (35) in the inner contour of the mouth of the top container.

In the inside of the cap there is a ring-shaped base (34) that comprises the support means of the wing (19), just as it will be described hereinafter.

Besides, the edge of the cap has a plurality of teeth (25) that have a widening in the bottom part thereof sideways to which the safety seal (24) is connected by a point.

On its part the safety seal (24) is provided with a plurality of flelxible wings (26) that remain in an oblique position, and which extend beyond the top edge of the safety seal (24), in such a way that they contact with the bottom edge of the cap (25).

Besides, the safety seal is provided with an axial wing (29) that is arranged on its surface of a furrow or stria to improve grasping by the user and whose end hs a connecting point (31), that has to be broken to remove the seal, in such a way that it comprises a safety pre-seal that also prevents snagging in the assembly machine.

It should be pointed out that in the inside top part of the cap there is a hollow cylinder (32) that comprises the sealing means of the hole (21) of the medicine dropper (20), just as it is described hereinafter.

Once the tubular sleeve (15) has been assembled on the top container, just it was already described, it facilitates the assembly of the cap (23) screwing it on the thread (14) of the top container, a circumstance that obliges the flexible wings (26) to bend upon the sawteeth (12) located in the top container, which prevents the deformation of the safety seal in the sealing, preventing locking from taking place, in such a way that it ensures the perfect sealing of the container.

Screwing of the cap (23) is done until the bottom edge of the safety seal (24) rests on the flap (9), a circumstance in which the flexible wings (26) act as stopping columns, upon contacting with the edge of the cap, helping the safety seal to achieve this effect, thus increasing the stopping stress.

In the process of screwing the cap, the ring-haped base (34) rests on the wing (19) of the tubular sleeve (15), pushing the tubular sleeve until it stops as cited above. Or previously the wing (19) has been located in the required position.

Besides, in this situation, the hollow cylinder (32) is inserted in the slightly truncated-cone-shaped hole (21) of the medicine dropper (20), in such a way that in the processing of screwing the hollow cylinder absorbs the radial deformation, permitting the effect of rotating and pushing the tubular sleeve without there being any problem of it being locked in the center thereof.

Once the different elements that comprise the container of the invention have been assembled and sealed, in order to begin to use the container, the point (31) is broken by pulling on the wing (29), a circumstance that allows breakage of the connection points (35) and the points that connect the safety seal with the teeth (25), doing this breaking in a simple manner.

Figure 5:
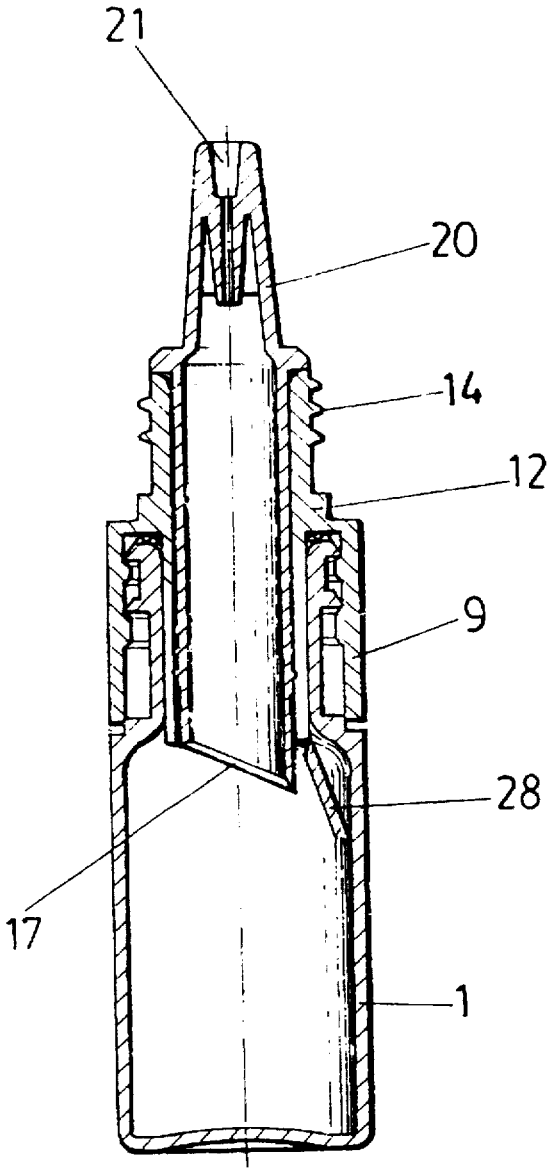
FIG. 5 is a section view similar to that of FIG. 3, but in its arrangement for use, this after the seal has been removed and the the bottom of the top container has been broken by screwing of the cap, which is not shown in this figure.
Figure 6:
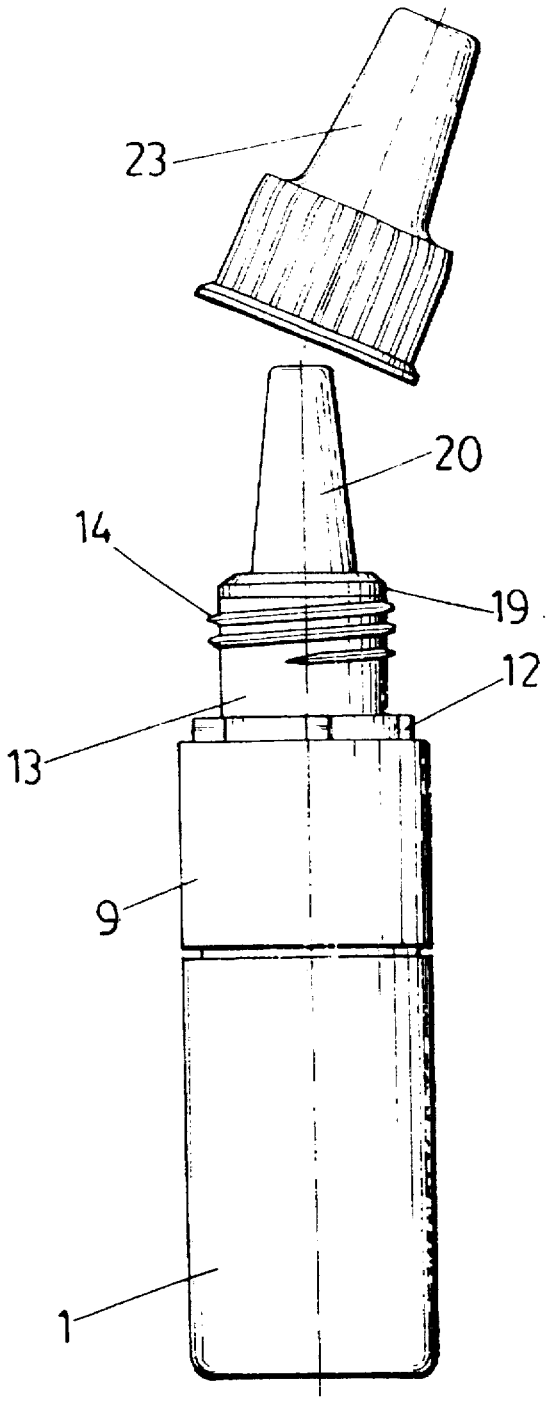
FIG. 6 is a raised view that is not sectioned of the previous figure including the cap.
Figure 7:
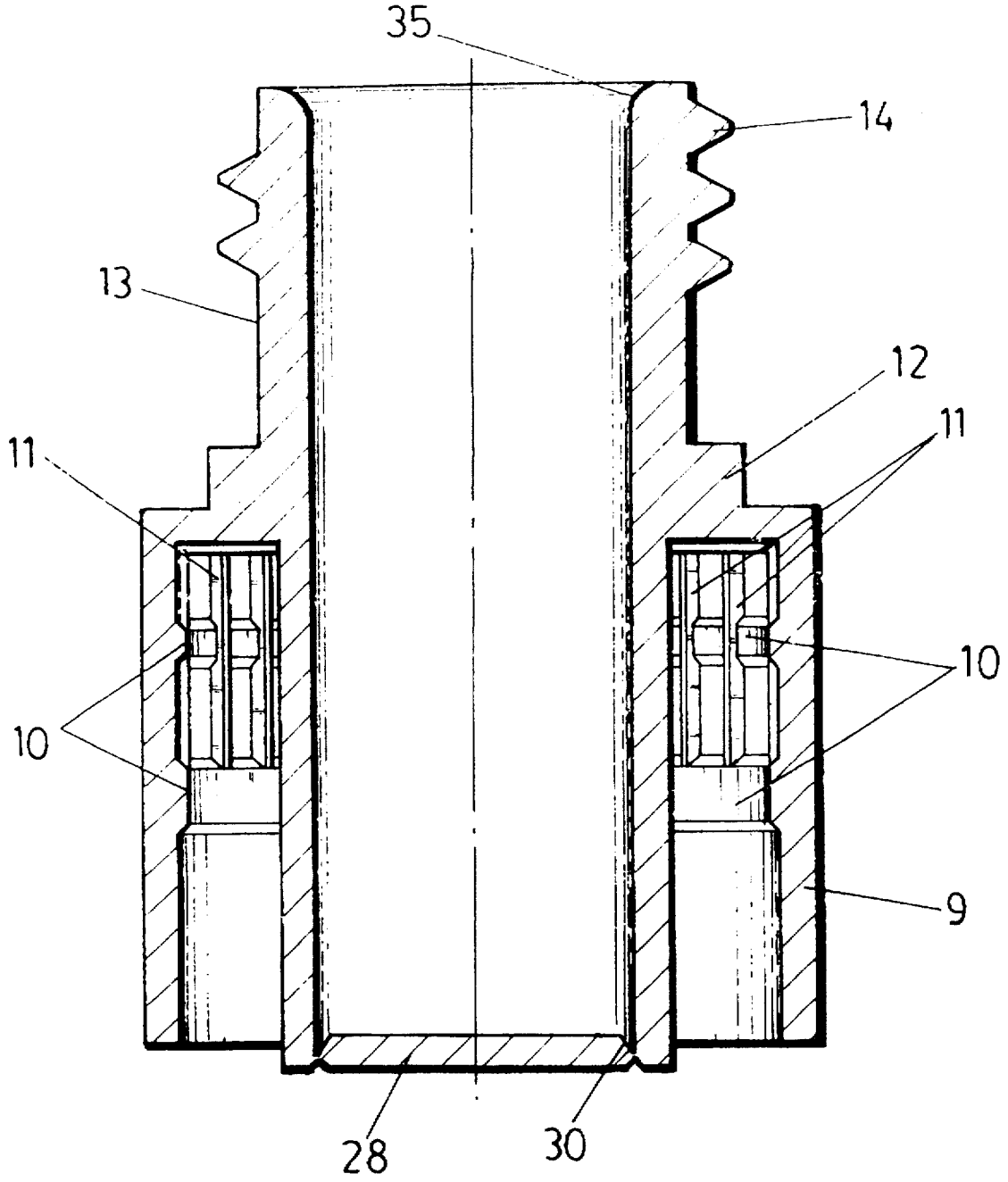
Figure 8:
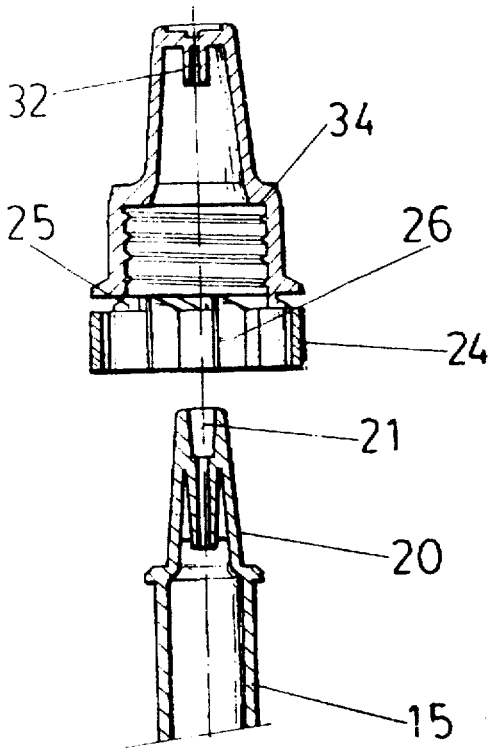
FIG. 8 is a view according to a longitudinal section of the cap and a partial sectioned view of the tubular sleeve, for the purpose of clarifying the arrangement of the cap with regard to the same.
Figure 9:
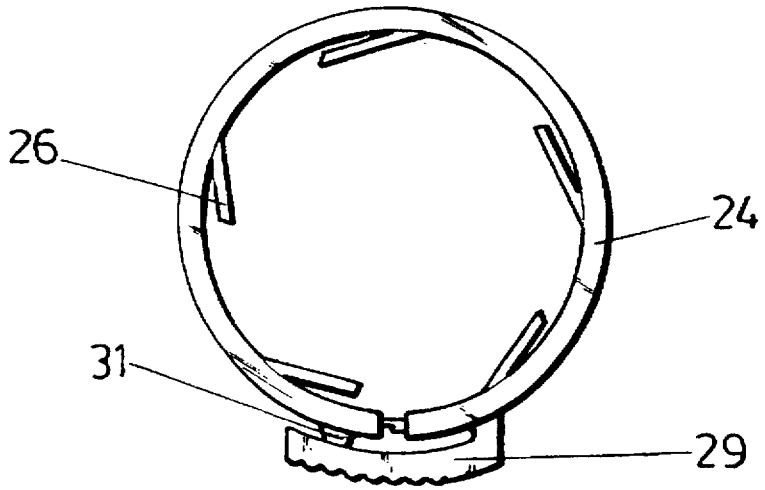
FIG. 9 shows a plan view of the safety seal after having been separated from the cap, for the purpose of clearly showing the arrangement of the flexible wings.
Figure 10:
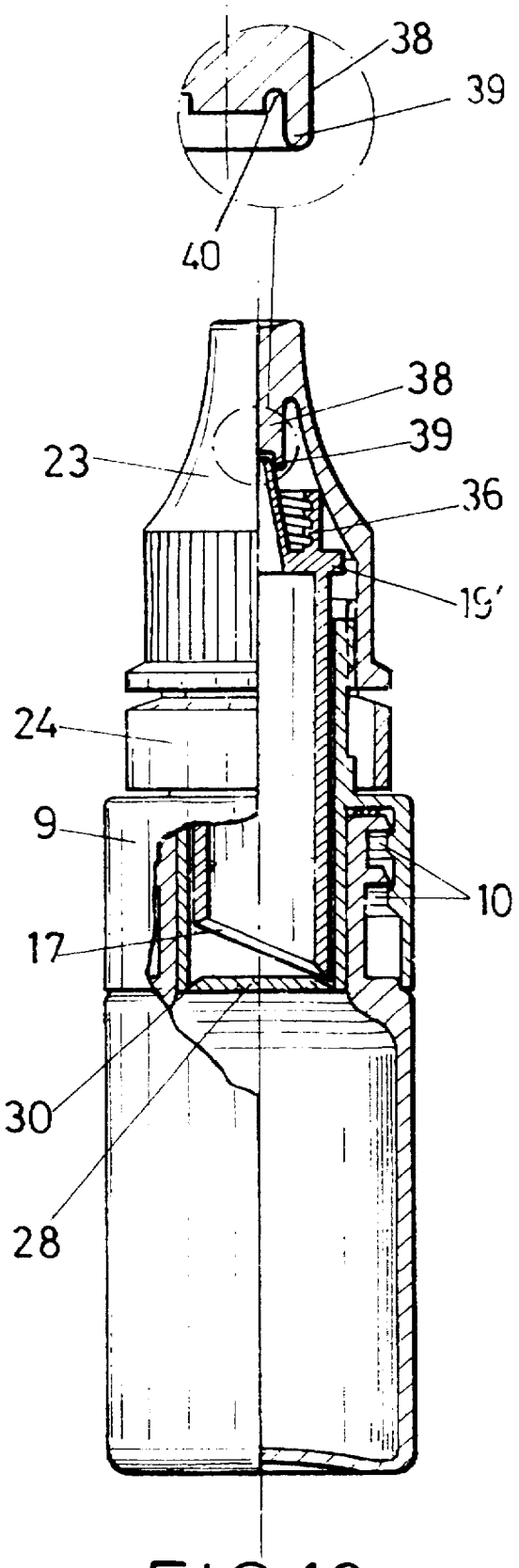
FIG. 10 is a partially sectioned view with the container totally assembled, of a possible embodiment, which includes in the wing that finishes the tubular sleeve, a hollow cylindrical extension placed outside and coaxially constituting the means that allows the coupling of the container to diff rent medical tools. In this embodiment, the way of sealing the end of the truncated-cone-shaped elements with the cap has been varied.
Figure 11:
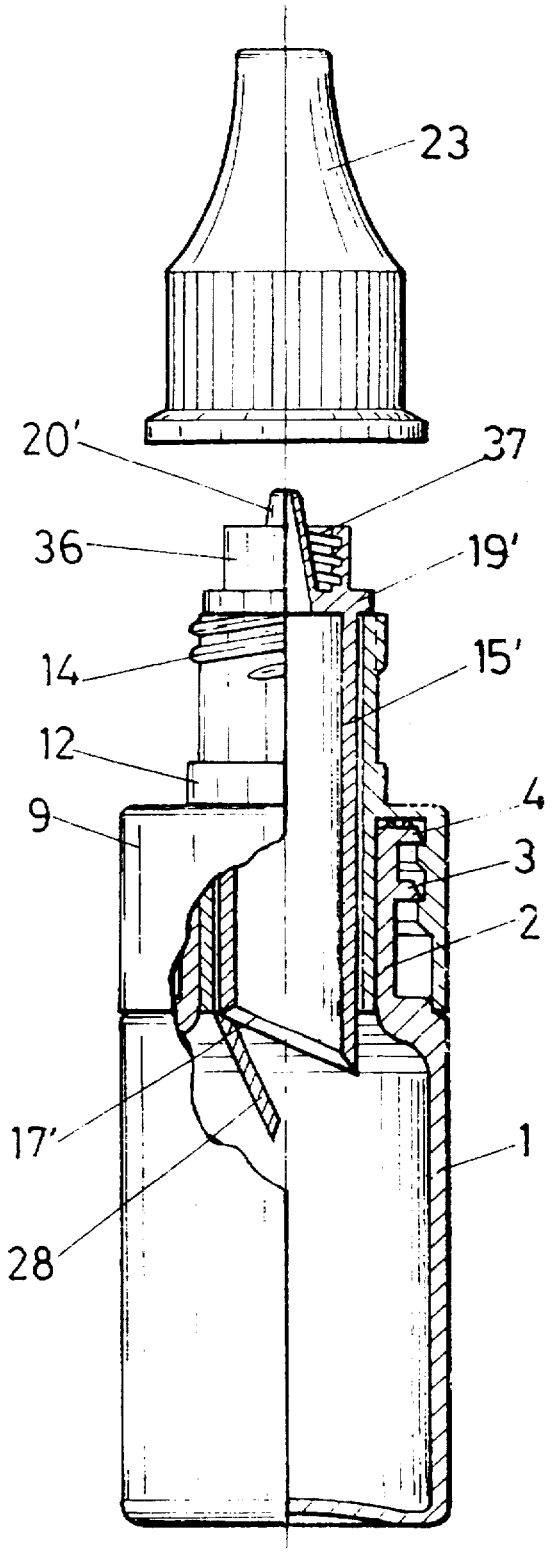
FIG. 11 shows a partially sectioned view of the embodiment of the above figure, but with the tearable bottom broken and the cap removed.

In this circumstance, one can continue to screw the cap (23) on the thread (14) of the top container, a circumstance that determines that the ring-shaped base (34) presses on the wing (19)forcing the tubular sleeve (15) to move axially. In the movement thereof, its helicoidal edge (17) presses on the tearable bottom that defines a gentle cutting that prevents the forming of particles and facilitates handling by the user, said tearing being done all along the helicoidal surface, with the exception of the horizontal point (18), commented on above, whereby the tearable bottom (28) does not come loose and it remains connected to the top container, just as it is shown in FIG. 5.

The operations of screwing on and screwing off the cap are made easier by the arrangment of the striae (6) and (11) that prevent the top and bottom containers from turning with regard to each other, as it has b een commented on above.

It is important to point out that the number of flexible wings (26) does not have to coincide in number or position with the sawteeth (12) provided for in the top container, which prevents locking.

It is obvious that said flexible wings (26), though they have been described with an oblique shape, they may be likewise radial.

The outside geometric shape of the cap (23) in the gripping area is cylindrical to prevent sliding and/or the coming loose of the cap upon screwing with the automatic screwer, besides this area has a narrow and depp striae with different curvature to improve the user s comfort and quality of the product.

Another possibility that the container of the invention contemplates, consists of varying the wing (19) of the tubular sleeve (15) to obtain a wing (19') in which the inclusion of a hollow cylinder (36) that remains placed coaxially to the truncated-cone-shaped body (20) by means of which dosing takes place, is made possible.

The hollow cylinder (36) has on its inside surface a helicoidal thread (37) in such a way that this unit allows coupling of the container to the different medical tools that are provided with a cylindrical connector that includes outside a helicoidal thread ("LUER LOK" connection) that is complemented with the helicoidal thread (37) of the hollow cylinder (36), which allows screwing on and coupling between both elements.

There is the possiblity that the truncated-cone shaped body (20) is of the conventional type, such as the one referred to as (20'), which does not include the slightly reversed truncated-cone-shaped widening (21), circumstance which makes it necessary to modify the sealing of the cap, for which purpose instead of using a hollow cylinder (32) in the cap, in the center there is a cylindrical projection (38) that is finished at the bottom with a ring-shaped edge (39), in such a way that upon screwing the cap (23) the mouth of the truncated-cone-shaped body (20') is located inside the ring-shaped edge, achieving the sealing and thus preventing the mouth of the hole of the medicine dropper from undergoing any damage or deformation.

There are truncated-cone-shaped portions (20') in whose mouth there is a perimetric edge, for which purpose the base of the cylindric body (38) and then the ring-shaped edge (39) include a ring-shaped channel (40) wherein the said perimetric edge of the truncated-cone-shaped body (20') is located, achieving the perfect sealing of the container.

Therefore, by means of the structure described, a container with a greater airtightness and damage-proofness against undesired actions is achieved, at the same time that it has a superior ergonomy and its assembly is made easier as done in the process that is described hereinafter.

First of all, the bottom container is filled with the corresponding product (normally a liquid). Then it is closed with the top container and the unit is weighed, in such a way that since the weight of both containers is known one determines if the filling has been done correctly or not. Then the top container is filled (normally with a small amount of powder) and the unit is weighed again, knowing if the filling has been correct or not. Then the tubular sleeve is assembled on the top container and the cap with the seal is screwed on, the container remaining capped and sealed.

It is obvious that the second weighing can be done in any step of the assembly process after having filled the top container, since the weight of each one of the elements that comprise the container is known.

We claim:

1. A container, comprising:

a) a bottom container closed at a bottom end and open at a top end opposite the bottom end, the top end defined by a tubular neck having a peripheral edge containing a first set of stria, an interior of the tubular neck further having a plurality of sealing rings;

b) a top container open at a top end and closed at a bottom end opposite the top end by a tearable seal, the top container engaging the sealing rings of the bottom container when the top container is inserted into the interior of the tubular neck;

c) a flap extending radially out from an exterior of the top container so that the flap surrounds the neck of the bottom container when the top container is inserted into the interior of the tubular neck, an interior of the flap having a second set of stria that engage the first set of stria; and d) a tubular sleeve having a bottom end and a top end, the bottom end defined by a beveled edge and the top end closed by a truncated cone, the bottom end of the tubular sleeve being sized and shaped to be received within the open end of the top container;

wherein the tubular sleeve may be moved axially within the top container so that the beveled edge tears the tearable seal in the top container.

2. The container of claim 1 wherein the bottom container further comprises a perimetric shoulder sized and shaped to center automatically the top container and the bottom container during assembly.

3. The container of claim 1 wherein the peripheral edge of the bottom container is beveled.

4. The container of claim 1 wherein the truncated cone comprises a medicine dropper.

5. The container of claim 1 wherein the truncated cone comprises a means for threadably coupling the container to a medical tool.

6. A container, comprising:

a) a top container open at a top end and closed at a bottom end opposite the top end by a tearable seal;

b) a bottom container having a perimetric shoulder, the shoulder sized and shaped to center automatically the top container and the bottom container during assembly, the bottom container closed at a bottom end and open at a top end opposite the bottom end, the top end defined by a tubular neck having a peripheral edge containing a first set of stria;

c) a flap extending radially out from an exterior of the top container so that the flap surrounds the neck of the bottom container when the top container is inserted into the interior of the tubular neck, an interior of the flap having a second set of stria that engage the first set of stria; and d) a tubular sleeve having a bottom end and a top end, the bottom end defined by a beveled edge and the top end closed by a truncated cone, the bottom end of the tubular sleeve being sized and shaped to be received within the open end of the top container;

wherein the tubular sleeve may be moved axially within the top container so that the beveled edge tears the tearable seal in the top container.

7. The container of claim 6 wherein an interior of the bottom container tubular neck further comprises a plurality of sealing rings.

8. The container of claim 6 wherein the peripheral edge of the bottom container is beveled.

9. The container of claim 6 wherein the truncated cone comprises a medicine dropper.

10. The container of claim 6 wherein the truncated cone comprises a means for threadably coupling the container to a medical tool.

11. A container, comprising:

a) a bottom container closed at a bottom end and open at a top end opposite the bottom end, the top end defined by a tubular neck having a peripheral edge containing a first set of stria;

b) a top container open at a top end and closed at a bottom end opposite the top end by a tearable seal;

c) a flap extending radially out from an exterior of the top container so that the flap surrounds the neck of the bottom container when the top container is inserted into the interior of the tubular neck, an interior of the flap having a second set of stria that engage the first set of stria; and d) a tubular sleeve having a bottom end and a top end, the bottom end defined by a beveled edge and the top end closed by a means for threadably coupling the container to a medical tool, the bottom end of the tubular sleeve being sized and shaped to be received within the open end of the top container;

wherein the tubular sleeve may be moved axially within the top container so that the beveled edge tears the tearable seal in the top container.

12. The container of claim 11 wherein an interior of the bottom container tubular neck further comprises a plurality of sealing rings.

13. The container of claim 11 wherein the peripheral edge of the bottom container is beveled.

14. The container of claim 11 wherein the bottom container further comprises a perimetric shoulder sized and shaped to center automatically the top container and the bottom container during assembly.

* * * * *